US006306338B1

(12) United States Patent
Rauch et al.

(10) Patent No.: US 6,306,338 B1
(45) Date of Patent: Oct. 23, 2001

(54) MELT WITHDRAWAL DEVICE FOR MELT FURNACES FOR CHARGING CASTING MACHINES

(75) Inventors: Erich Rauch; Otto Ehrentraut; Alfred Sigmund, all of Gmunden (AT)

(73) Assignee: Ing. Rauch Fertigungstechnik Gesellschaft m.b.H., Gmunden (AT)

( * ) Notice: Subject to any disclaimer, the term of this patent is extended or adjusted under 35 U.S.C. 154(b) by 0 days.

(21) Appl. No.: 09/525,816

(22) Filed: Mar. 15, 2000

(51) Int. Cl.[7] ..... C21C 5/42
(52) U.S. Cl. ..... 266/239; 222/591
(58) Field of Search ..... 266/236, 239, 266/45; 222/590, 591; 417/359

(56) References Cited

U.S. PATENT DOCUMENTS

| | | | | |
|---|---|---|---|---|
| 3,759,635 | * | 9/1973 | Carter et al. | 266/239 |
| 4,398,589 | | 8/1983 | Eldred . | |
| 5,441,390 | * | 8/1995 | Rapp et al. | 266/239 |

FOREIGN PATENT DOCUMENTS

| | | |
|---|---|---|
| 44 20 655 | 12/1995 | (DE) . |
| 195 41 093 | 5/1997 | (DE) . |
| 0 609 197 | 1/1994 | (EP) . |

* cited by examiner

*Primary Examiner*—Scott Kastler
(74) *Attorney, Agent, or Firm*—Collard & Roe, P.C.

(57) ABSTRACT

A melt withdrawal device for melt furnaces for charging casting machines has a melt conveying pump (1) comprised of a pump tube (2) forming a lower melt inlet (3) and an upper melt outlet (4) and of a pump shaft (5) extending inside the pump tube (2) and carrying a pump rotor (6). To achieve a melt conveyance which is largely independent of the melt level variations inside the melt furnace and can thus be dosed property, a charging means (7) for keeping constant the pump head (h) is provided before the melt conveying pump (1), which charging means (7) comprises a charging tank (8) accommodating the pump tube (2) with the melt inlet (3) and a charging pump (10) capable of filling the charging tank (8) with melt up to a melt overflow (9) determining the charging height, where the delivery rate of the charging pump (10) exceeds that of the conveying pump (1).

13 Claims, 7 Drawing Sheets

4
5
1
2
h
0
9
13
7
U
6
8
S
11
3
14
12
10

5
1
h
0
9
2
7
13
U
8
6
S
3
15
16
14
10
12

1
h
0
9
7
13
8
U
S
15
17
14
12
10

MELT WITHDRAWAL DEVICE FOR MELT FURNACES FOR CHARGING CASTING MACHINES

FIELD OF THE INVENTION

This invention relates to a melt withdrawal device for melt furnaces for charging casting machines, comprising a melt conveying pump including a pump tube forming a lower melt inlet and an upper melt outlet and a pump shaft extending inside the pump tube and carrying a pump rotor.

DESCRIPTION OF THE PRIOR ART

A prerequisite for the proper charging of casting machines or similar means is the possibility of a functionally reliable and dosable melt conveyance from the storage space of melt and holding furnaces, where so far, as is disclosed in EP 0 609 197 B, DE 195 41 093 A or DE 44 20 655 A, screw pumps have mostly been used as conveying pumps, whose delivery rate depends, however, on the pressure conditions in the melt inlet area of their pump tubes and thus on the respective pump head, which leads to a considerable impairment of the dosability of the pump delivery rates, since the melt level heights in the melt storage space of the melt furnaces vary considerably during operation.

From U.S. Pat. No. 4,398,589 A a pumping device for liquid metal is already known, which operates according to the electromagnetic principle and in which a feedback control of the delivery rate is possible. The pumping device must, however, be disposed outside the melt furnace, which leads to considerable thermal difficulties.

SUMMARY OF THE INVENTION

It is therefore the object underlying the invention, to create a melt withdrawal device as described above, which is characterized by its delivery rates largely independent of changes in the melt level.

This object is solved by the invention in that before the melt conveying pump a charging means is provided for keeping constant the pump head, which charging means comprises a charging tank accommodating the pump tube with the melt inlet and a charging pump capable of filling the charging tank with melt up to a melt overflow determining the charging height, where the delivery rate of the charging pump exceeds that of the conveying pump. Since the charging tank is filled with melt up to the melt overflow, this charging means with its charging tank and the charging pump ensures constant pressure conditions in the melt inlet area of the melt conveying pump during the withdrawal operation, so that even with external variations in the melt level a constant melt level height, i.e. charging height, determining the pressure conditions is effective for the melt conveying pump, and independent of the respective melt level heights in the storage space of the melt furnaces a constant pump head is obtained for the melt conveying pump, and thus the delivery rates can exactly be metered as desired. The overflow itself will lie in the vicinity of the maximum melt level, in order to adapt the pressure conditions to the actual circumstances and to avoid the maintenance of unnecessary charging heights. The charging pump should also be adjusted to the conveying pump, so that on the one hand a sufficient excess of melt is conveyed into the charging tank, in order to exclude a decrease of the melt level inside the charging tank below the melt overflow during a withdrawal of melt, but on the other hand to be able to ensure a constant pump head with a rather low melt overflow. As melt conveying pump and as charging pump all suitable conveying pumps can be used, and there are also obtained all kinds of embodiments for the charging means itself.

The charging tank may, for instance, be comprised of a chamber which surrounds the melt inlet and includes a lower intake opening and a rising pipe extending upwards and forming the melt overflow, and the charging pump may have a charging rotor seated in the vicinity of the intake opening. There is obtained a compact constructional unit of melt conveying pump and charging means, where the flow cross-section of the rising pipe will be dimensioned rather small in consideration of the risk of solidification-related obstructions and the like.

To prevent in a simple way that in the case of a standstill of the pump the melt level height inside the charging tank decreases down to the respective melt level height in the storage space, which without an additional control effort for prefilling the charging tank before the actual withdrawal of melt would involve initial variations in the pump head, the intake opening has associated thereto a backflow check valve with a valve body closing the intake opening opposite to the intake direction, so that with the charging pump standing still the backflow check valve will close the intake opening and prevent the melt from flowing out of the charging tank, whereby also at the beginning of the withdrawal substantially unchanged pressure conditions and charging heights are ensured.

As valve body of the backflow check valve suitable valve plates or the like may be inserted in corresponding valve housings, but advantageously it is also possible that the charging rotor itself, which is vertically movably disposed above the intake opening, forms the valve body, so that the charging rotor moving upwards with a drive rotation will clear the intake opening and the driveless charging rotor moving downwards under the influence of its own weight will again close the intake opening.

An expedient construction is obtained when the charging tank is arranged coaxial to the pump tube, which allows the formation of charging chamber and rising pipe as a stepped tube portion.

It is basically irrelevant according to which operating principle conveying pump and/or charging pump are operating, but a coaxial arrangement of pump rotor and charging rotor involves certain advantages. The pump shaft may for instance extend downwards from the pump tube and with its protruding end serve as drive shaft for the charging rotor, so that a common drive for both pumps is obtained.

The charging rotor may of course also be seated on a separate drive shaft extending through the hollow pump shaft, whereby a greater adaptability of the charging pump capacity to the respective circumstances is achieved.

Another expedient embodiment of the charging means consists in that the charging tank comprises two partial tanks, a charging part accommodating the pump tube and closed at the bottom and a filling part accommodating the charging pump and having the lower intake opening, where filling part and charging part are in flow connection with each other via an overflow edge and the filling part forms the melt overflow. The charging part ensures the constant charging height and due to its closed bottom this charging part at the same time prevents this charging height from decreasing in the case of a standstill of the pump, so that in essence a constant pump head is always ensured. The filling part with the charging pump ensures the filling or melt application of the charging part with a corresponding excess of melt, so that again uniform pressure conditions independent of external variations in the melt level are obtained for the melt conveying pump.

An expedient constructional unit is in turn obtained when charging part and filling part are arranged coaxial to the pump tube and the filling part surrounds the charging part, where the charging pump has a charging rotor seated below the charging part on a drive shaft extending from the charging part. The filling part inwardly verges into the charging part and with its upper marginal edge forms the melt overflow to the outside. As a drive shaft for the charging pump the bottom end of the pump shaft may be used, but there may also be provided a separate drive shaft for the charging rotor, which extends through the hollow pump shaft.

When in accordance with another constructional solution charging part and filling part are arranged one beside the other and the charging pump of the filling part has a drive shaft which is parallel to the pump shaft and includes a lower charging rotor, a pumping means completely independent of the melt conveying pump may be provided as charging pump, which pumping means provides for an optimization of the charging operation, for instance by prefilling the filling part before the beginning of the withdrawal, and the like.

To be able to use largely identical components, the filling part accommodates a pump which is similar to the melt conveying pump as charging pump, whose melt outlet preferably opens into the charging part, which with substantially identical pumping means leads to a perfect charging operation for the withdrawal device.

To obtain a withdrawal device directly associated to a melt furnace, the charging tank may be incorporated in a melt furnace, wherein the charging part forms a withdrawal chamber separate from the storage space of the melt furnace and connected to the storage space via the filling part. The charging means is thus integrated in a melt furnace and ensures the desired constant pump heads of the melt conveying pump incorporated in the charging part.

A melt level measuring means may be provided in the charging part, and the charging pump drive may be activatable in dependence on the melt level, so that a charging means can be installed which can exactly be adapted to the withdrawal conditions.

BRIEF DESCRIPTION OF THE DRAWING

In the drawing, the subject-matter of the invention is represented in detail by way of example, wherein.

DESCRIPTION OF THE PREFERRED EMBODIMENTS

Figure 1:
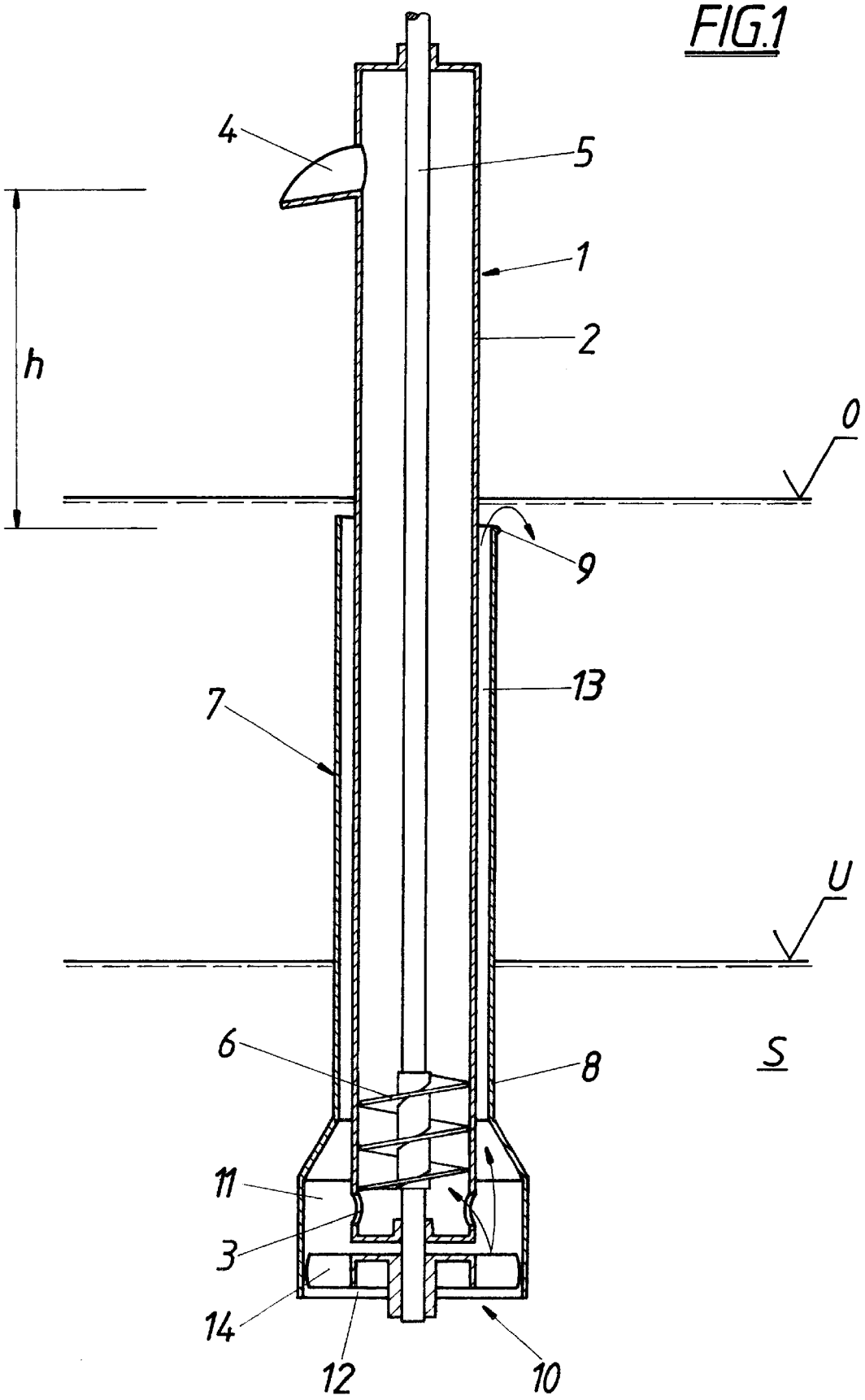
FIGS. 1,2,3,4,5,6 and 7 illustrate seven embodiments of an inventive melt withdrawal device, each with reference to an axial section.

A melt withdrawal device for charging casting machines or the like has a melt conveying pump 1 immersed into the melt bath S of a melt furnace not represented in detail, which melt conveying pump includes a pump tube 2 with a lower melt inlet 3 and an upper melt outlet 4 and a pump shaft 5 extending inside the pump tube 2 and drivable via a drive motor not represented in detail, which pump shaft has a conveying screw above the melt inlet 3 as pump rotor 6, so that when the pump shaft 5 is rotated, melt is sucked in through the melt inlet 3 and is moved upwards via the pump tube 2 to the melt outlet 4.

To ensure a melt conveyance largely independent of the variations in the melt level of the melt bath S between a maximum melt level O and a minimum melt level U and thus to ensure a properly dosable melt withdrawal, a charging means 7 is provided before the melt conveying pump for keeping constant the pump head, which charging means comprises a charging tank 8 accommodating the pump tube 2 with the melt inlet 3 and a charging pump 10 capable of filling the charging tank with melt up to a melt overflow 9 determining the charging height, so that the charging means 7 ensures a constant pump head h for the melt conveying pump 1 as a result of the difference in height between melt outlet 4 and melt overflow 9, with the overflow 9 being located in the vicinity of the maximum melt level O of the melt bath S.

In accordance with the embodiment shown in FIG. 1, the charging tank 8 is comprised of a chamber 11 surrounding the melt inlet 3, which chamber has a lower intake opening 12 and an upwardly extending rising pipe 13 forming the melt overflow 9. Chamber 11 and rising pipe 13 are coaxial to the pump tube 2, and the charging pump 10 has a charging rotor 14 which is likewise coaxial to the pump rotor 6 and below the pump 2 in the vicinity of the intake opening 12 is seated on the pump shaft 5 which extends downwards from the pump tube. When the melt conveying pump is put into operation, the charging pump 10 is driven together with the pump rotor 6, which charging pump delivers melt from the melt bath S into the chamber 11 via its charging rotor 14 and is dimensioned such in its performance that despite the amount of melt discharged by the melt conveying pump 1 an excess of melt is moved upwards through the rising pipe 13 to the overflow 9 and is caused to flow over and back into the melt bath. In the vicinity of the melt inlet 3 of the melt conveying pump 1 there is thus always obtained a charging height determined by the height of the melt overflow 9, which charging height ensures a constant pump head h and makes the delivery rate of the melt conveying pump 1 independent of the respective melt level of the melt bath.

Figure 2:
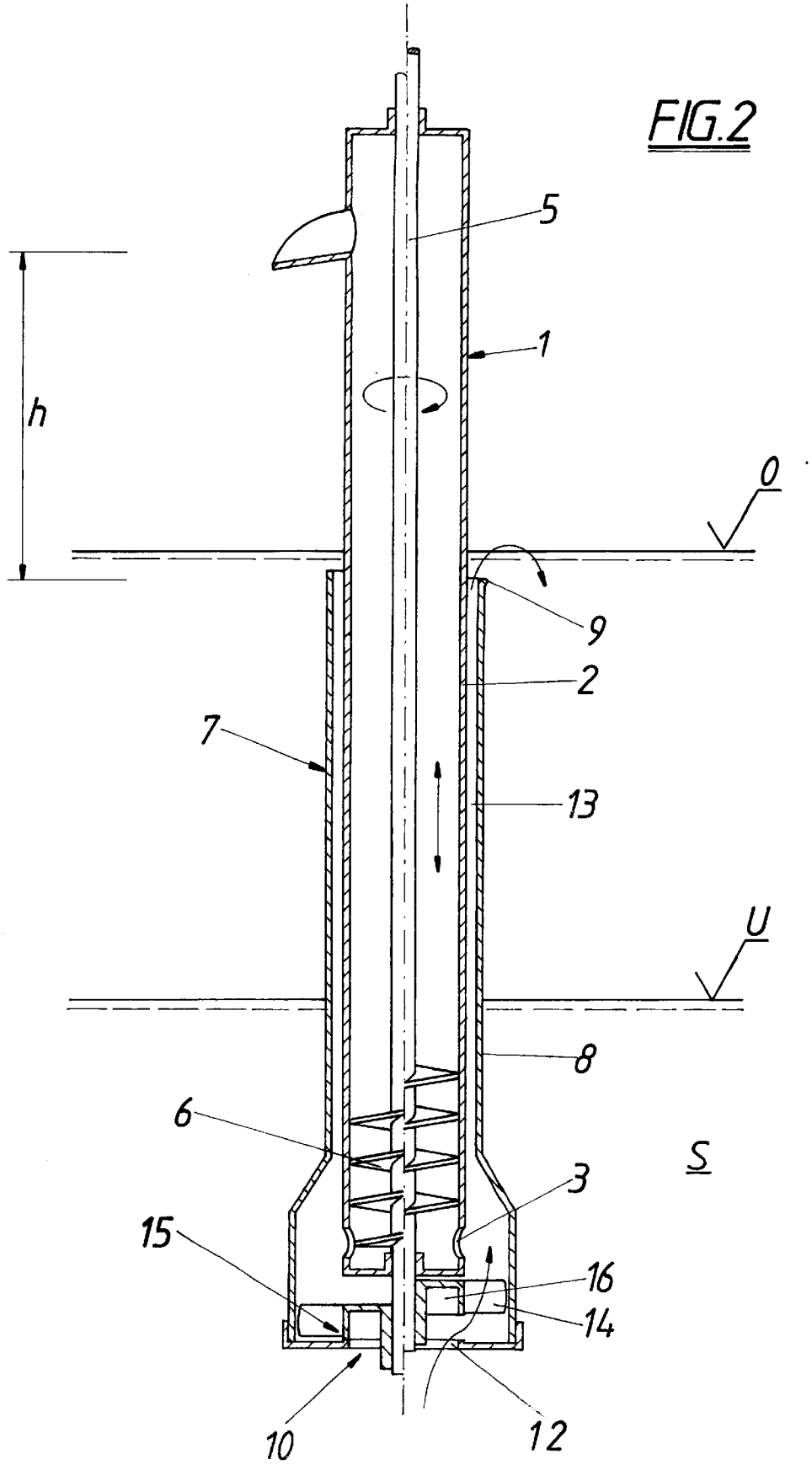
Figure 3:
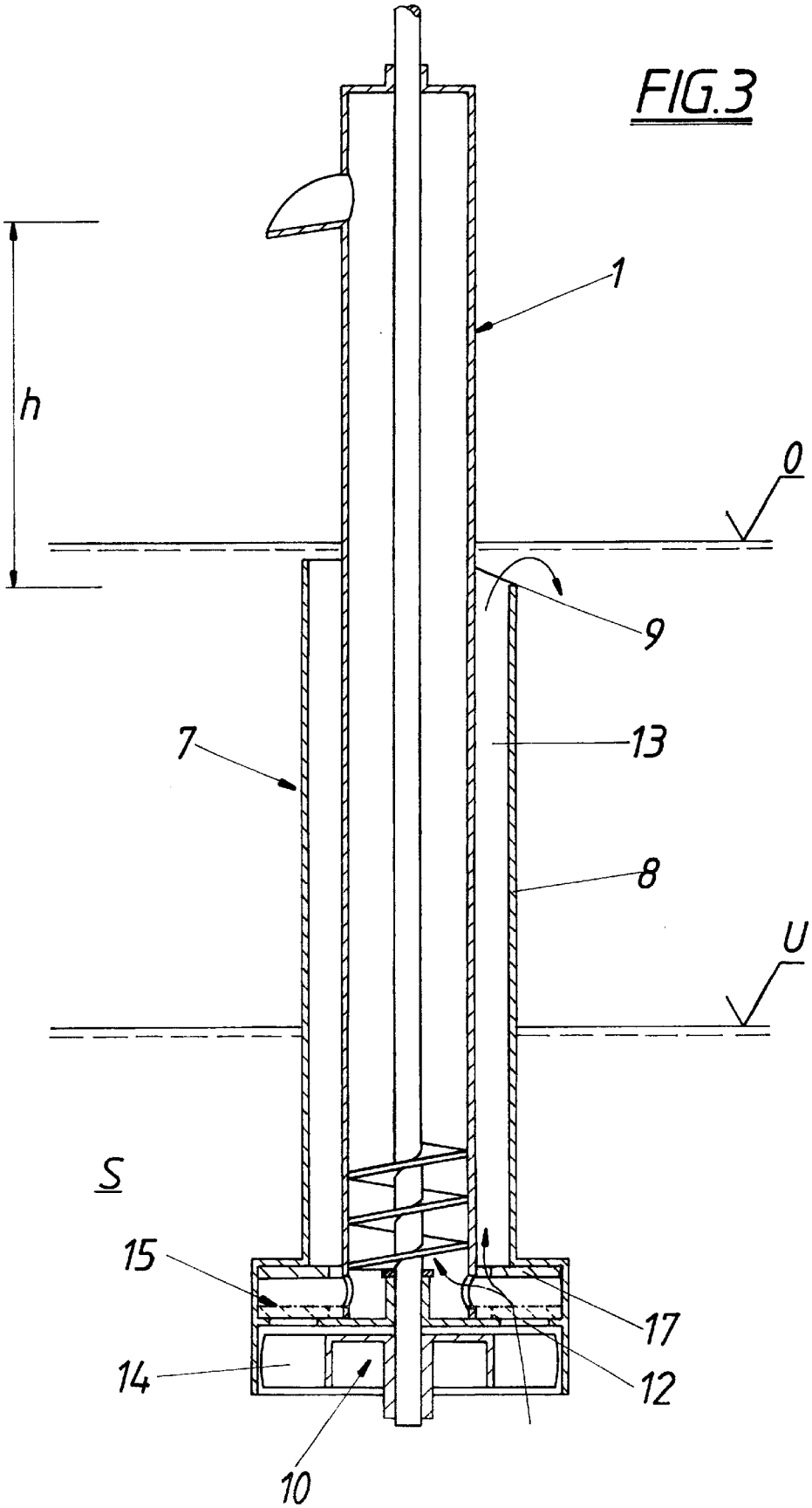

To prevent the melt level in the rising pipe 13 from decreasing in the case of a standstill of the pump and to thereby avoid variations in the pump head at the beginning of a melt withdrawal, the intake opening 12 in accordance with the embodiments shown in FIGS. 2 and 3 has associated thereto a backflow check valve 15, which by means of a valve body 16 closing the intake opening 12 opposite to the intake direction, which valve body may be a part of the vertically movably arranged charging rotor 14 (FIG. 2) or a separate valve plate 17 (FIG. 3), prevents the melt from flowing back from the rising pipe 13 in the case of an interruption of the charging pump operation.

Figure 4:
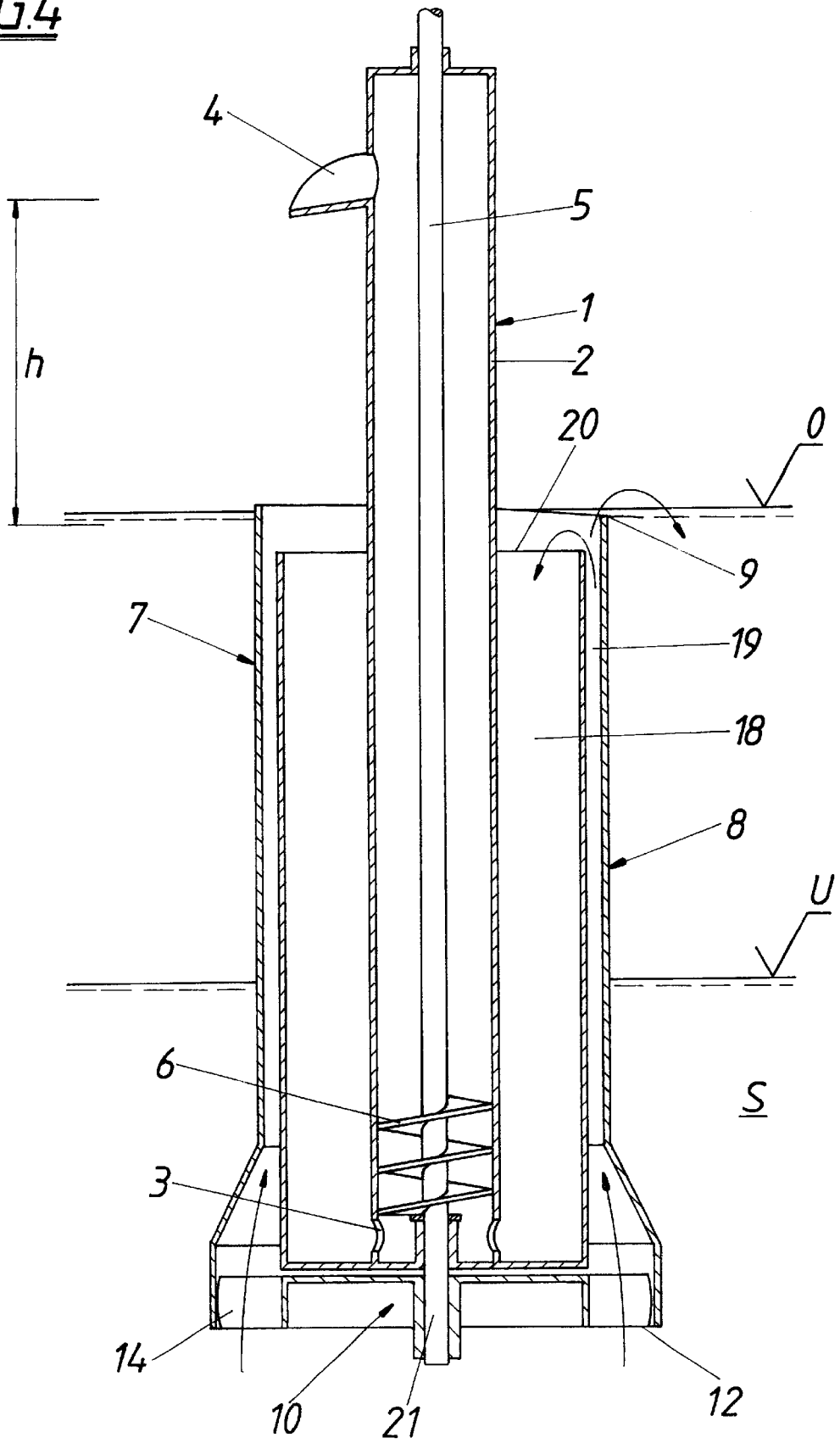

In accordance with the embodiment shown in FIG. 4, the charging tank 8 of the charging means 7 comprises two partial tanks, a charging part 18 accommodating the pump tube 2 and closed at the bottom and a filling part 19 accommodating the charging pump 10 and having the lower intake opening 12, where the filling part and the charging part are in flow connection with each other via an overflow edge 20 and the filling part 19 forms the melt overflow 9. Via the charging pump 10 melt is pumped from the melt bath S into the filling part 19 until on the one hand it fills the charging part 18 via the overflow edge 20 and on the other hand it flows back into the melt bath via the melt overflow 9. Via the melt overflow 9 the constant pump head h is thus ensured for the withdrawal of melt, and the charging part 18 in addition prevents a decrease of the charging height below the level predetermined by the overflow edge 20 also during a standstill of the pump.

Figure 5:
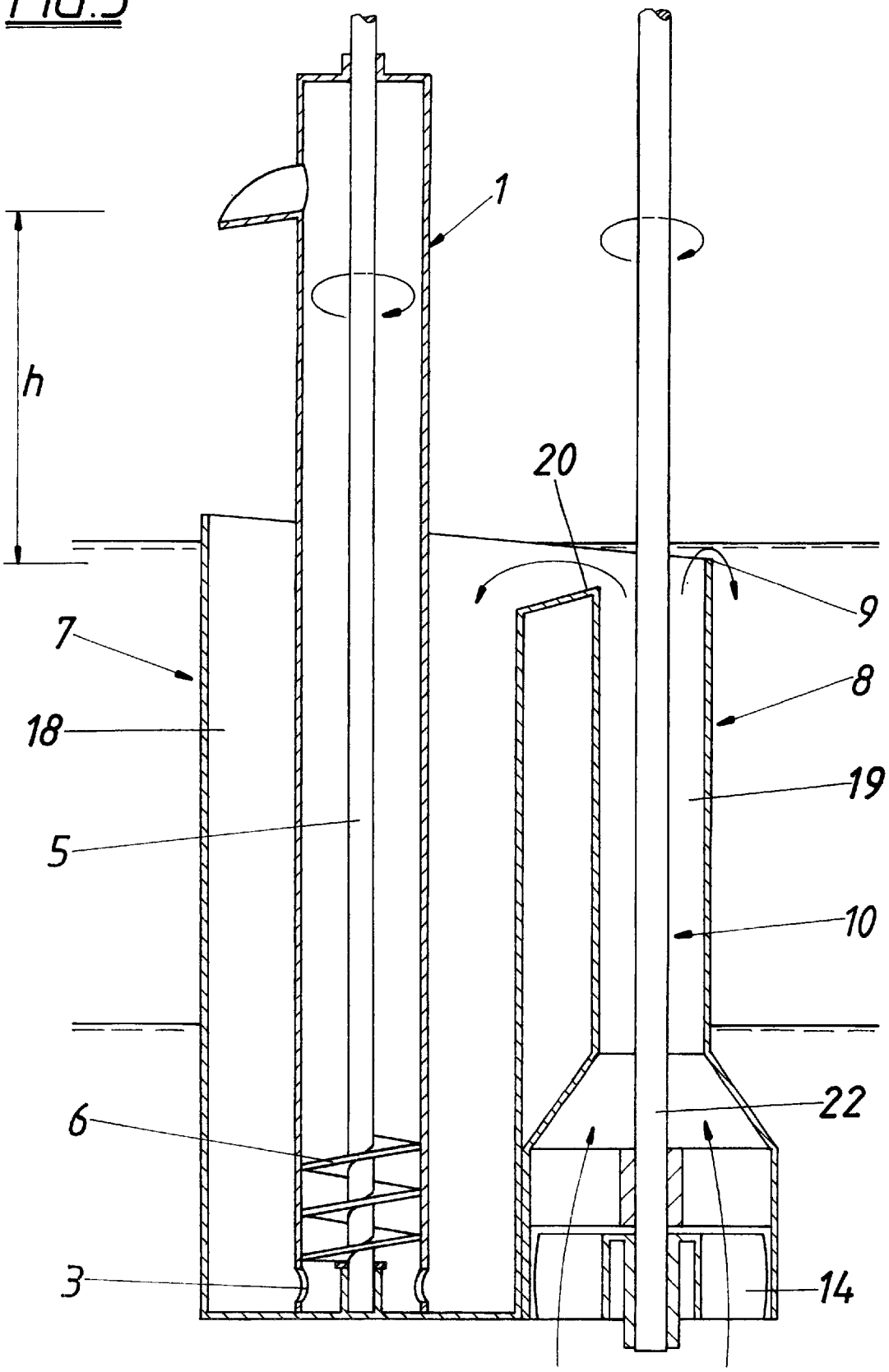

The embodiment in accordance with FIG. 5 likewise shows a charging tank 8 with a charging part 18 and a filling part 19, where charging part and filling part are arranged one beside the other and are in flow connection with each other via an overflow edge 20. The charging part is filled with melt via the filling part, and the melt overflow 9 of the filling part 19 determines the constant pump head h for the withdrawal of melt. In contrast to the embodiment shown in FIG. 4, according to which the charging pump 10 has a charging rotor 14 seated below the charging part at the elongated end 21 of the pump shaft 5, the embodiment in accordance with FIG. 5 includes a charging pump 10 parallel to the melt conveying pump 1, which charging pump has its own drive shaft 22 and a suitable charging rotor 14 in the filling part 19, so that by means of an independent charging pump control the charging operation can exactly be adapted to the withdrawal operation.

Figure 6:
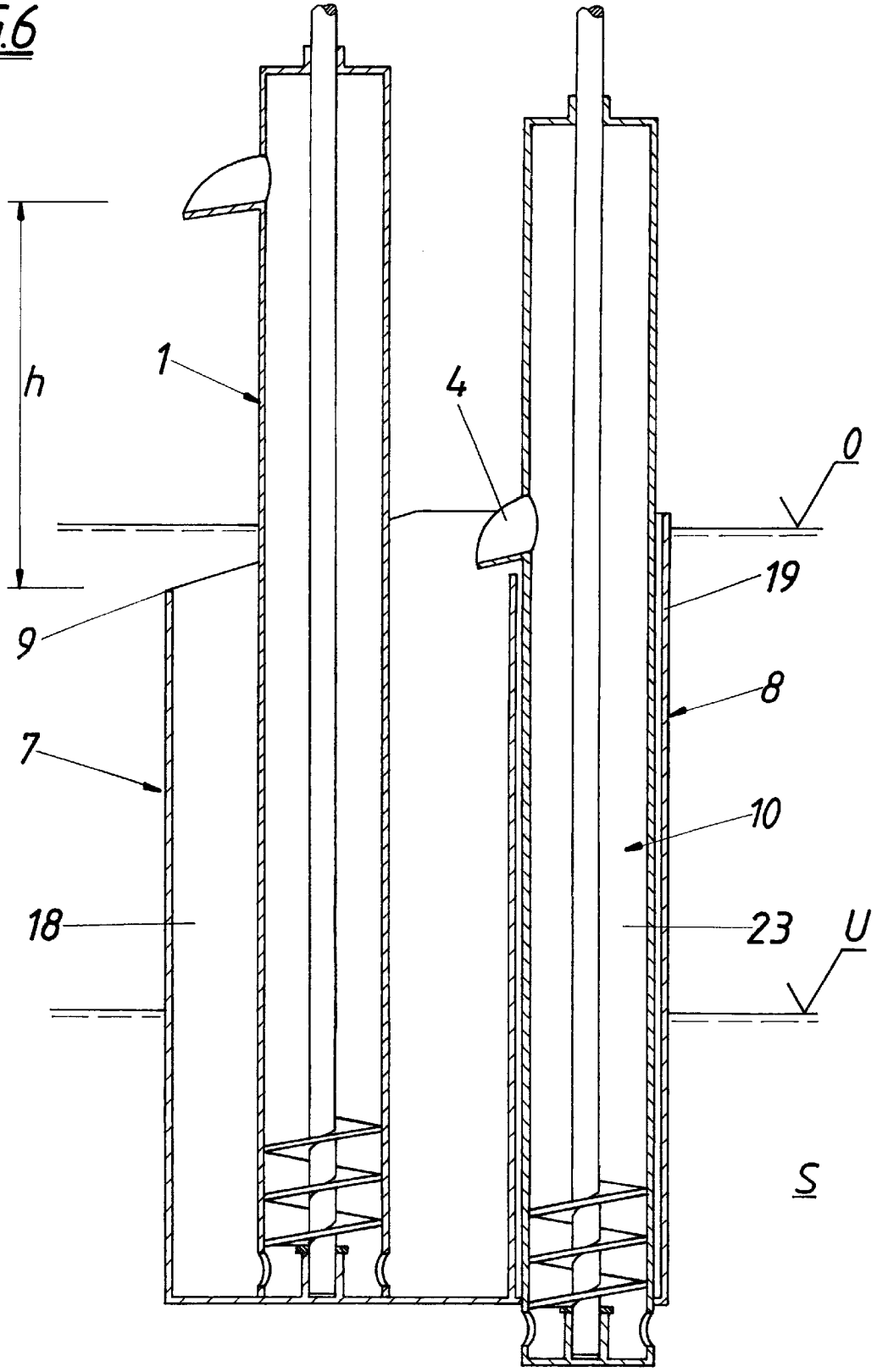

In FIG. 6 there is provided an embodiment which is similar to the embodiment shown in FIG. 5 and includes charging and filling parts 18, 19 disposed one beside the other, where the possibility is indicated that a pump 23 identical with the conveying pump 1 can be used as charging pump 10, whose melt outlet 4 opens into the charging part 18.

Figure 7:
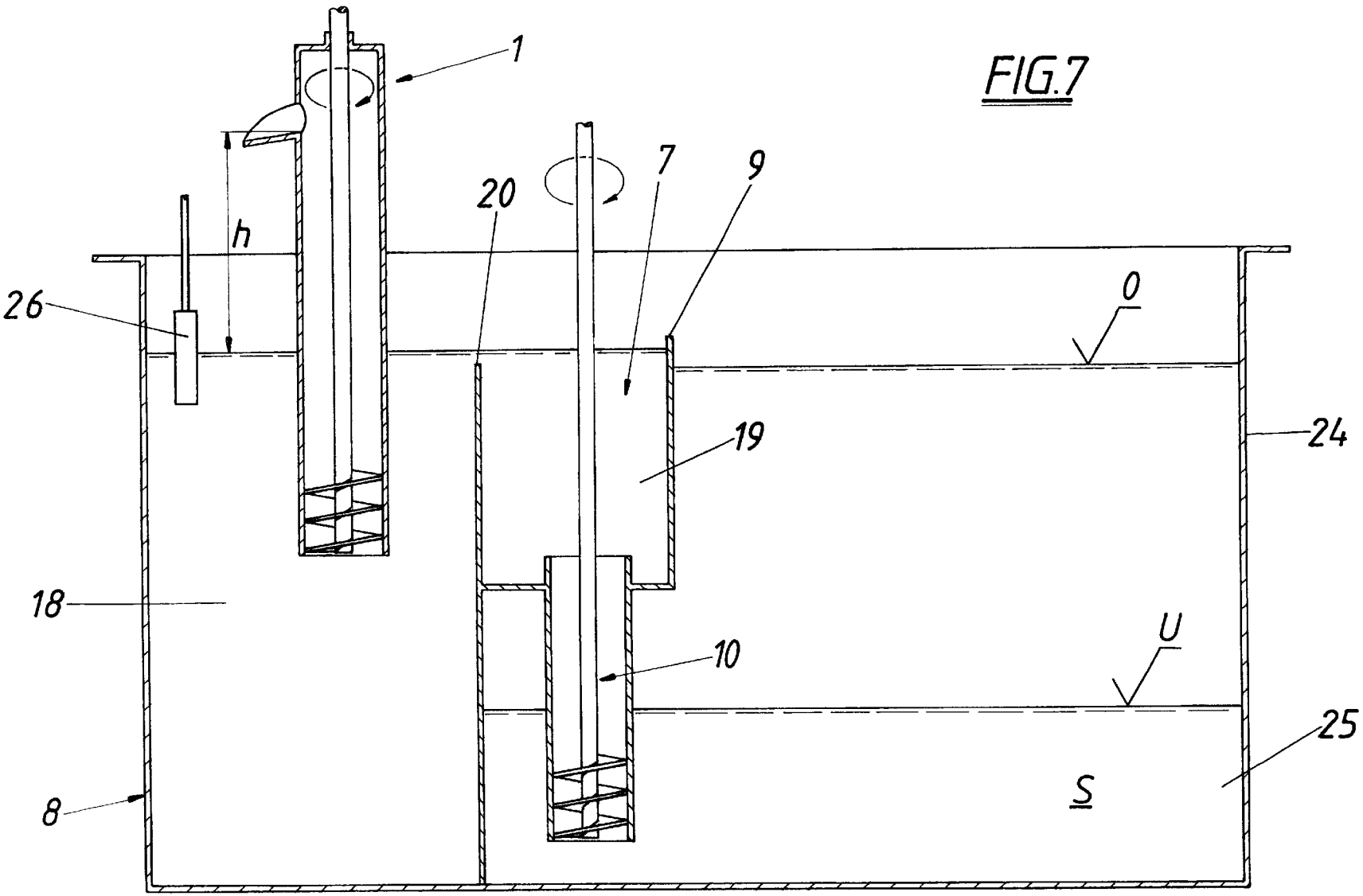

As is indicated in FIG. 7, the charging means 7 may also be incorporated directly in a melt furnace 24, where the charging tank 8 of the charging means 7 is integrated in the storage space 25 of the melt furnace 24 and with its charging part 18 forms a withdrawal chamber separate from the storage space 25 and connected to the storage space 25 via the filling part 19. Here as well an overflow edge 20 is provided between charging part 18 and filling part 19, which overflow edge determines the desired level in the withdrawal chamber, and the upper edge of the filling part 19 forms a melt overflow 9 for the back flow of melt into the storage space 25 in the case of an overfill. The charging pump 10 delivers melt from the storage space 25 into the filling part 19, from where this melt reaches the charging part 18 via the overflow edge 20 and for the withdrawal of melt is kept at a largely constant melt level by the conveying pump 1, which largely constant melt level in turn ensures a constant pump head h. When a melt level measuring means 26 is used in the withdrawal chamber, the drive of the charging pump 10 can be controlled in dependence on the melt level of the withdrawal chamber, so that a fine adjustment of the charging operation to the withdrawal operation can be effected.

What is claimed is:

1. A melt withdrawal device for melt furnaces for charging casting machines, comprising a melt conveying pump (1) including a pump tube (2) forming a lower melt inlet (3) and an upper melt outlet (4) and a pump shaft (5) extending inside the pump tube (2) and carrying a pump rotor (6), characterized in that before the melt conveying pump (1) a charging means (7) is provided for keeping constant the pump head (h), which charging means (7) comprises a charging tank (8) accommodating the pump tube (2) with the melt inlet (3) and a charging pump (10) to be filled with melt up to a melt overflow (9) determining the charging height, where the delivery rate of the charging pump (10) exceeds that of the conveying pump (1).

2. The melt withdrawal device as claimed in claim 1, characterized in that the charging tank (8) is comprised of a chamber (11) surrounding the melt inlet (3), which chamber has a lower intake opening (12) and an upwardly extending rising pipe (13) forming the melt overflow (9), and the charging pump (10) has a charging rotor (14) seated in the vicinity of the intake opening (12).

3. The melt withdrawal device as claimed in claim 2, characterized in that the intake opening (12) has associated thereto a backflow check valve (15) with a valve body (16, 17) closing the intake opening (12) opposite to the intake direction.

4. The melt withdrawal device as claimed in claim 3, characterized in that the charging rotor (14) itself, which is disposed above the intake opening (12) so as to be vertically movable, forms the valve body (16).

5. The melt withdrawal device as claimed in claim 2 characterized in that the charging tank (8) is disposed coaxial to the pump tube (2).

6. The melt withdrawal device as claimed in claim 2 characterized in that the pump shaft (5) downwardly extends from the pump tube (2) and with its protruding end serves as drive shaft for the charging rotor (14).

7. The melt withdrawal device as claimed in claim 2, characterized in that the charging rotor is seated on a separate drive shaft extending through the hollow pump shaft.

8. The melt withdrawal device as claimed in claim 1, characterized in that the charging tank (8) comprises two partial tanks, a charging part (18) accommodating the pump tube (2) and closed at the bottom and a filling part (19) accommodating the charging pump (10) and having the lower intake opening (12), where filling part and charging part are in flow connection with each other via an overflow edge (20) and the filling part (19) forms the melt overflow (9).

9. The melt withdrawal device as claimed in claim 8, characterized in that charging part (18) and filling part (19) are disposed coaxial to the pump tube (2) and the filling part (19) surrounds the charging part (18), where the charging pump (10) has a charging rotor (24) seated below the charging part (18) on a drive shaft extending out of the charging part.

10. The melt withdrawal device as claimed in claim 8, characterized in that charging part (18) and filling part (19) are disposed one beside the other, and the charging pump (10) of the filling part (19) has a drive shaft (22) which is parallel to the pump shaft (5) and includes a lower charging rotor (14).

11. The melt withdrawal device as claimed in claim 8, characterized in that the melt outlet (4) opens into the charging part (18).

12. The melt withdrawal device as claimed in claim 8, characterized in that the charging tank (8) is incorporated in a melt furnace (24), where the charging part (18) forms a withdrawal chamber separate from the storage space (25) of the melt furnace (24) and connected to the storage space (25) via the filling part (19).

13. The melt withdrawal device as claimed in claim 12, characterized in that in the charging part (18) a melt level measuring means (26) is provided and the charging pump drive can be activated in dependence on the melt level of the charging part (19).

* * * * *

UNITED STATES PATENT AND TRADEMARK OFFICE

CERTIFICATE OF CORRECTION

PATENT NO. : 6,306,338 B1
DATED : October 23, 2001
INVENTOR(S) : Rauch et al.

It is certified that error appears in the above-identified patent and that said Letters Patent is hereby corrected as shown below:

Title page,
Item [30], please insert the Foreign Priority as follows:
-- [30] Foreign Application Priority Data
September 10, 1998 (AT) …… A 1526/98 --.

Signed and Sealed this

Third Day of December, 2002

JAMES E. ROGAN
*Director of the United States Patent and Trademark Office*

UNITED STATES PATENT AND TRADEMARK OFFICE

CERTIFICATE OF CORRECTION

PATENT NO. : 6,306,338 B1
DATED : October 23, 2001
INVENTOR(S) : Erich Rauch et al.

It is certified that error appears in the above-identified patent and that said Letters Patent is hereby corrected as shown below:

This certificate supersedes Certificate of Correction issued December 3, 2002, the number was erroneously mentioned and should be vacated since no Certificate of Correction was granted.

Signed and Sealed this

Sixth Day of May, 2003

JAMES E. ROGAN
*Director of the United States Patent and Trademark Office*